United States Patent [19]

Chung

[11] Patent Number: 4,524,648

[45] Date of Patent: Jun. 25, 1985

[54] FIXATION TWEEZERS

[76] Inventor: Charng J. Chung, No. 199, Kuang-Ming St., Yuan-Lin Chen, Changhua, Taiwan

[21] Appl. No.: 641,827

[22] Filed: Aug. 17, 1984

[51] Int. Cl.[3] ..... B25B 9/02

[52] U.S. Cl. ..... 294/99.2; 128/354

[58] Field of Search ..... 81/43; 294/99 R, 99 S; 128/354, 321; 7/900; D28/55

[56] References Cited

U.S. PATENT DOCUMENTS 1,726,624 9/1929 Lawson ..... 294/99 R 2,381,084 8/1945 Slad ..... 128/354

FOREIGN PATENT DOCUMENTS 204639 8/1939 Switzerland ..... 294/99 S

*Primary Examiner*—Roscoe V. Parker

*Attorney, Agent, or Firm*—Lackenbach Siegel Marzullo Presta & Aronson

[57] ABSTRACT

A pair of tweezers for gripping a workpiece in fixed position without exerting pressure by use of the thumb and index finger, having a fixed handle and a movable handle riveted at one end thereof and capable of gripping things on the other end, a spring-controlled member is pivotally mounted between the two handles, when pulling the member against the resistance offered by a expansion spring, the member can be pivotally rotated to a position where a pair of handles are forced open, permitting the gripping of the workpiece, after releasing the pulling force, the spring-controlled member will return to a normal closed position to grip the workpiece firmly.

3 Claims, 4 Drawing Figures

FIXATION TWEEZERS

BACKGROUND OF THE INVENTION

This invention relates to a pair of tweezers and particularly concerns a pair of fixation tweezers which can hold a workpiece without being constantly pressed by the hand.

The conventional tweezers are made of a metal piece and provided with a pair of jaws for gripping the workpiece under a pressure from the thumb and index finger. For a person, such as a nurse, who usually works with such tweezers to grasp things, such as absorbent cotton, sterile gauze, etc., such a construction is apt to cause fatigue because the jaws must be closed by keeping constant pressure on the tweezers by use of the thumb and index finger. In another aspect, while holding a workpiece with the known tweezers, the workpiece being grasped may become misplaced when a person releases his hold on the tweezers.

Furthermore, the absorbent cotton or a similar substance is apt to adhear to the jaws after becoming wet which causes difficulty in removing it from the tweezers.

SUMMARY OF THE INVENTION

Therefore, the general object of this invention is to provide a novel fixation tweezers with which a workpiece can be gripped without exerting constant pressure manually,.

It is another object of this invention to provided a fixation tweezers having a push rod, with it, the gripped workpiece can be removed when opening the grasping jaws.

In accordance with this invention, the fixation tweezers comprising a fixed handle having a first front end defining a first grasping jaw with straight working surface and a first rear end; a movable handle including a second front end defining a second grasping jaw having working surface parallel with that of the first grasping jaw and a second rear end fixed with the first rear end; an expansion spring member having a first end and a end secured on the fixed handle; a controlling member pivotably mounted between the fixed handle and the movable handle and connected with the first end of the expansion spring being made with a configuration that capable of being rotated pivotably against the biassing of said spring thereby achieving an opened position, that the first and second grasping jaws being spaced apart and permitting a workpiece to be gripped therebetween, and when released by the controlling member, returning to a closed position, so that the first and second grasping jaws are clamping against the workpiece.

In another aspect of this invention, the controlling member is a flat piece having a length longer than that of the spacing between the fixed handle and the movable handle, and normally it is tilted between the first and second grasping jaws under the biassing of the expansion spring, the controlling member can be turned vertically between the fixed and movable handles to space apart the first and second grasping jaws and permitting a workpiece to be inserted therebetween, when the turning force is released, the controlling member returning to the tilted position and thus the workpiece between the grasping jaws can be gripped firmly.

In a further aspect of this invention, a push bar is associated with the controlling member and capable of protruding beyond the first and second grasping jaws when the controlling member is turned to open the grasping jaws.

BRIEF DESCRIPTION OF THE DRAWINGS

The preferred exemplary embodiment will be described in detail with respect to the following drawings, wherein.

DETAILED DESCRIPTION OF THE PREFERRED EMBODIMENT

Figure 1:
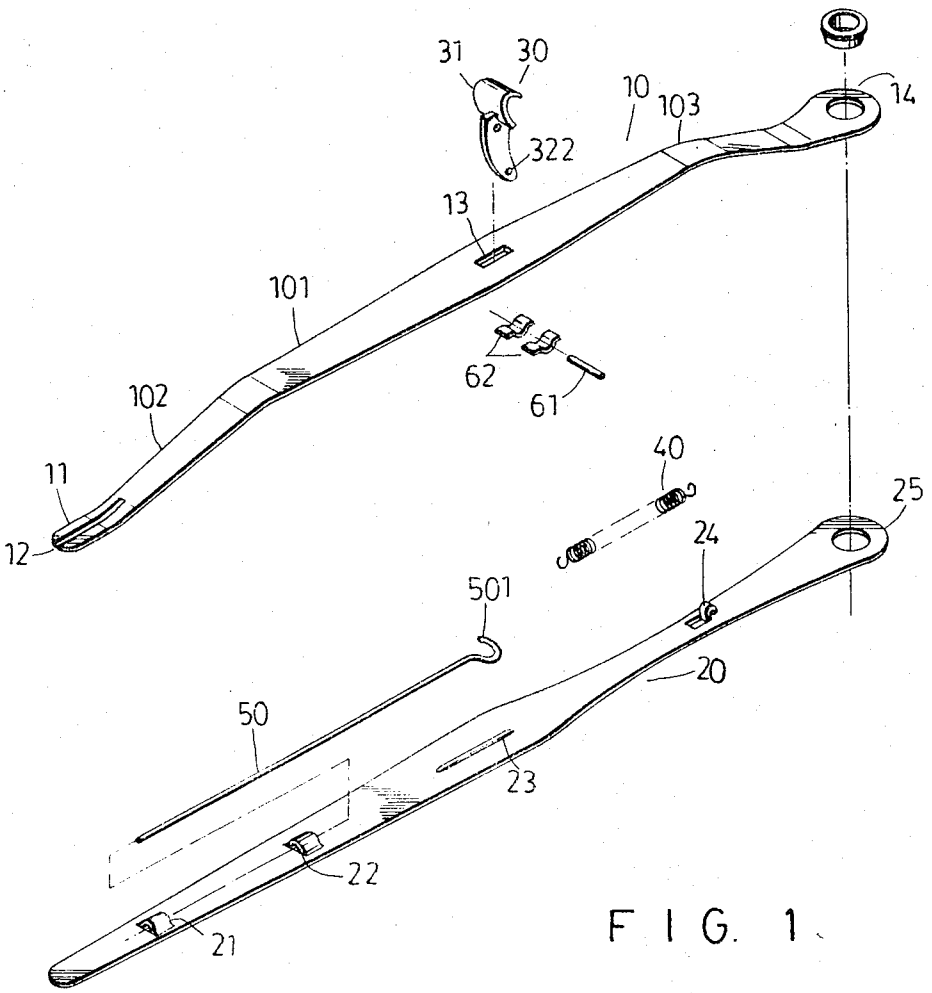
FIG. 1 is an exploded view of the tweezers according to a preferred embodiment according to this invention.

Referring first to FIG. 1, wherein shown is the element of the tweezers according to the preferred embodiment, generally comprising a pair of working jaws and a spring controlling mechanism.

Reference numerals 10, 20 denotes a movable handle and a fixed handle respectively, the movable handle 10 including a straight middle portion 101 having a slit 13 formed thereon, a front bent portion 102 having a straight working jaw 11 defined at the frontmost end such that it runs parallel with the straight portion 101 but is not included in the same plane, a recess 12 extended through a length greater than the straight working jaw 11, the function thereof will be described hereinafter, and a rear bent portion 103 terminating in a straight end 14.

The fixed handle 20 is formed of a straight piece, thereby it can close with the working jaw 11 and the rear straight end 14 of to the movable handle 10. In this embodiment, the movable handle 10 and the fixed handle 20 are riveted at their respective rear ends 14, 25.

The controlling mechanism comprises a controlling member 30 integrally formed with a lever 31, since the lever 31 is formed in transversal direction with respect to the controlling member 30, it is always maintained above the slit 13 when the controlling member 30 is passed through the slit 13 and disposed between the movable and fixed handles 10, 20. The controlling member 30 is pivoted to the movable handle 10 by means of a pivot pin 61, the pivot pin 61 is secured to the movable handle 10 by a pair of notched pieces 62, 62. In such a manner, the controlling member 30 is pivotable about the pivot pin 61 when the user pulls the lever 31. More preferably, the controlling member 30 is made of smooth contour, so that it is slidable on the fixed handle 20 smoothly.

As seen in the drawings, a groove 23 of proper length is provided on the fixed handle 20 for guiding the movement of the controlling member 30.

An expansion spring 40 is mounted on the fixed handle 20, with one end thereof connected to the lower end of the controlling member 30 so as to pull it toward the spring 40, according to such a structure, the controlling member 30 is maintained in an inclined position under the action of the spring 40, in this position, the controlling member 30 is accomodated in the enclosure defined between the movable and fixed handles 10, 20 unless a pulling force strong enough to overcome the force of the spring 40 be exerted on the lever 31 to cause pivoting of the same.

Preferably, the other end of the spring 40 is hooked up on a lourver 24 integrally formed on the fixed handle 20 near the riveted end by a lancing operation, the exact position thereof is apparent to one skilled in the art.

According to the preferred embodiment, the controlling member 30 is cooperative with the push bar 50, when pulling the controlling member 30 against the spring 40, the push bar 50 can be operated to protrude beyond the grasping end of the tweezers, therefore, the gripped workpiece can be easily removed.

The moving path of the push bar 50 is defined by the aligned notches 21, 22 formed by a shearing press, the push bar 50 is passed through the notches 21, 22 and operatively associated with the controlling member 30 via the hooked end 501 hooking on the hole 322 of the controlling member 30.

Figure 4:
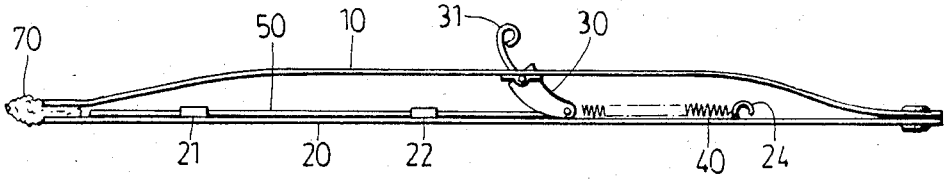
FIG. 4 is a side view of the tweezers as shown in the above indicated drawings, illustrating its position when grasping and holding an object.

It has been described hereinabove, as can be seen in FIG. 4, the recess 12 on the fixed handle is longer than the fixed jaw, therefore, the push bar 50 will not prevent the jaws from closing, since the front portion thereof can be received within the recess 12.

Figure 2:
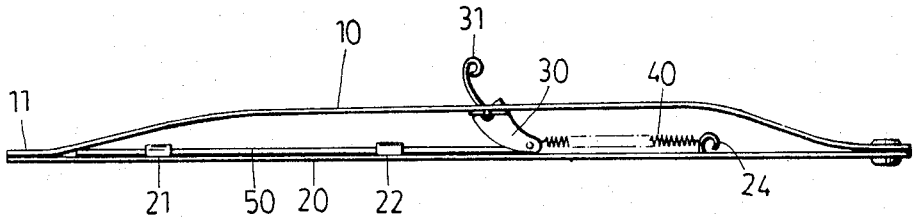
FIG. 2 is a side view of the tweezers shown in FIG. 1, showing a closed position thereof.
Figure 3:
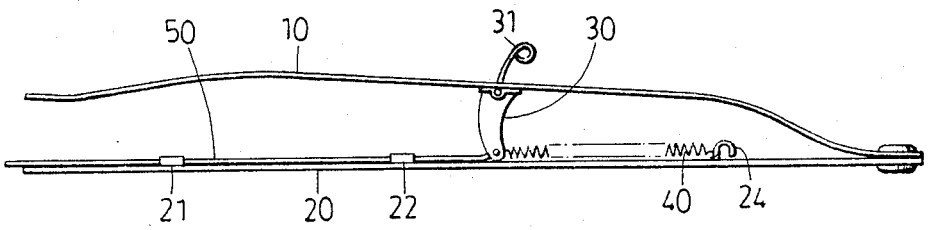
FIG. 3 is a side view of the tweezers shown in FIG. 1, showing an opened position thereof.

The operation of the tweezers according to this invention can be comprehended from FIGS. 2 to 4, in a non-use position, the controlling member 30 is inclined with respect to the movable and fixed handles 10, 20 under the action of the spring 40, so that the two jaws are closed. When something is intended to be gripped by the tweezers, the user should pull the lever 31 backward to open the jaws, the pulling direction is indicated by an arrow A in FIG. 3, immediately after grasping at the workpiece 70, he can loosen the lever 31, the workpiece 70 then is firmly held between the pair of jaws, as shown in FIG. 4.

While the invention has been described in connection with what is presently considered to be the mst practical and preferred embodiments, it is to be understood that the invention, is not to be limited to the disclosed embodiment, but on the contrary, is intended to cover various modifications and equivalent arrangements including within the spirit and scope of the appended claims which scope is to be accorded the broadest interpretation so as to encompass all such modifications and equivalent structures.

I claim:

1. A fixation tweezers comprising:

a fixed handle having a first front end defining a first grasping jaw with straight working surface and a first rear end;

a movable handle including a second front end defining a second grasping jaw having working surface parallel with that of said first grasping jaw and a second rear end fixed with said first rear end;

a spring member having a first end and a second end secured on said fixed handle;

a controlling member disposed between said movable handle and said fixed handle, with one end thereof pivotably mounted to said movable handle and the other end connected with said first end of said spring member, being made with a configuration capable of being rotated pivotably against the biassing of said spring to achieve an open position, where said first and second grasping jaws being spaced apart and permitting a workpiece to be gripped therebetween, and when releasing, said controlling member returning to a closed position, where said first and second grasping jaws clamping against the workpiece.

2. A fixation tweezers as claimed in claim 1, wherein said controlling member is a flat piece having a length longer than that of the spacing between said fixed handle and said movable handle, and normally it is tilted between said first and second grasping jaws under the biassing of said spring, said controlling member can be turned vertically between said fixed and movable handles to space apart said first and second grasping jaws and permitting a workpiece inserted therebetween, when the turning force is released, said controlling member returning to the tilted position and thus the workpiece between said grasping jaws can be gripped firmly.

3. A fixation tweezers as claimed in claim 1 or Claim 2, further comprising a push bar, which is associated with said controlling member and capable of protruding beyond said first and second grasping jaws when said controlling member is turned to open said grasping jaws.

* * * * *